US006991556B2

(12) United States Patent
LaTerra

(10) Patent No.: US 6,991,556 B2
(45) Date of Patent: Jan. 31, 2006

(54) GOLF SWING TRAINING HAT

(76) Inventor: Dante J. LaTerra, 32 Schulyer Ave., Stamford, CT (US) 06902

( * ) Notice: Subject to any disclaimer, the term of this patent is extended or adjusted under 35 U.S.C. 154(b) by 0 days.

(21) Appl. No.: 10/848,093

(22) Filed: May 18, 2004

(65) Prior Publication Data

US 2004/0266544 A1 Dec. 30, 2004

Related U.S. Application Data

(60) Provisional application No. 60/471,541, filed on May 19, 2003.

(51) Int. Cl.
*A63B 69/36* (2006.01)
*A42B 1/24* (2006.01)

(52) U.S. Cl. ..... 473/274; 473/208; 473/269; 2/209.13

(58) Field of Classification Search ..... 473/207–210, 473/266, 269, 274–275; 273/DIG. 17; D21/791; 2/171, 209.13, 410–6.5
See application file for complete search history.

(56) References Cited

U.S. PATENT DOCUMENTS

| | | | | | |
|---|---|---|---|---|---|
| 2,958,156 | A | * | 11/1960 | Schmahl et. al. | 446/27 |
| 3,098,316 | A | * | 7/1963 | McCarthy | 446/27 |
| 3,229,872 | A | * | 1/1966 | Williams | 224/181 |
| 3,437,339 | A | | 4/1969 | Starck | |
| 3,813,016 | A | * | 5/1974 | Bohannan | 224/162 |
| 4,762,325 | A | | 8/1988 | McCleery | |
| 4,881,654 | A | * | 11/1989 | Stazo et al. | 2/209.13 |
| 4,936,584 | A | | 6/1990 | Ewald et al. | |
| 5,425,620 | A | * | 6/1995 | Stroud | 416/63 |
| D443,328 | S | | 6/2001 | Martin et al. | |

* cited by examiner

*Primary Examiner*—Nini F. Legesse
(74) *Attorney, Agent, or Firm*—St. Onge Steward Johnston & Reens LLC

(57) ABSTRACT

A system and method for assisting an individual to perform a correct and accurate golf swing indicating to the individual if he has improperly rotated about his center line axis, the device being located on the top of or the crown of the individual's head so that it may be substantially aligned with the center line axis of the individual.

18 Claims, 5 Drawing Sheets

GOLF SWING TRAINING HAT

PRIOR APPLICATION

Applicant claims priority benefits under 35 U.S.C. §119 (e) of U.S. Provisional Patent Application Ser. No. 60/471,541 filed May 19, 2003.

FIELD OF THE INVENTION

The invention relates generally to a system and method for assisting an individual to improve their golf swing, and more particularly to a system and method for indicating to the individual when he has moved a portion of his body off of centerline.

BACKGROUND OF THE INVENTION

Golfers have been seeking ways to improve their golf swing for many years. Basic to a correct and accurate golf swing is the ability to maintain a straight center line down through the individual's body.

To achieve an accurate swing it is important that an individual's head, neck and torso remain inline with each other along a swing axis running down through the user. This imaginary axis extends from the top or crown of the individual's head, down through his neck and torso, through the hip and through the anus. Therefore, while the above listed body parts may twist relative to each other, it is important that they twist or rotate about the imaginary swing axis. The swing axis may be perpendicular to the ground or may be at some angle relative to the ground, the important point however is that the head, neck and torso align with each other about the swing axis.

A number of devices and systems have been proposed to help improve a golfer's swing.

For instance, U.S. Pat. No. 4,936,584 to Ewald et al. ("the '584 patent") teaches use of a hat having a cup located on the bill of the hat for receiving a ball therein. The idea is that if the user rotates or unduly moves his head, the ball will fall out of the cup indicating to the user that he improperly moved his head. However, a problem with the '584 patent is that the cup holding the ball is located on the bill of the hat, which does not correspond to the user's swing axis and as such, cannot indicate to the user if he is properly rotating about his swing axis. Rather, the '584 patent can only indicate improper head movement which is only one aspect of a proper and accurate golf swing. Therefore, the '584 patent, as well as other patents that locate the indicating device on or attached to the bill of the hat can indicate a false positive on the individual's swing because these devices are only directed toward one aspect of the golfer's swing.

Another device designed to improve an individual's golf swing is disclosed in U.S. Pat. No. 4,762,325 to McCleery et al. ("the '325 patent"), which is provided to encourage head immobility during swinging of the golf club and to aid in alignment of the club swing and movement with respect to the desired direction of ball travel. However, the '325 patent is also a device that is attached to the bill of a hat worn by a user that hangs down in front of the user's eyes. As such, it suffers from the same problems discussed in connection with the '584 patent namely, it does not indicate to the user whether or not he is accurately rotating about his swing axis and can indicate a false positive on the swing as long as the individual keeps his head straight. However, as mentioned previously, that is only one aspect of a proper and accurate golf swing.

Still other devices and systems have been provided such as those disclosed in U.S. Pat. No. 3,437,339 to Starck ("the '339 patent") and U.S. Design Pat. No. 443,328 to Martin et al. both of which teach use of a ball attached to the bill of a hat by an elongated member that allows the ball to swing according to the individual's movements. Both of the systems taught in these patents teach devices that indicate improper movements of the head to the user. However, again neither of these devices will indicate to the user if the user's body moves off of his swing axis.

Therefore, what is desired then is an apparatus that will indicate to a user when the user has moved his body off of his swing axis during a golf swing.

It is further desired to provide a device as described above that is adjustable so as to fit multiple users.

It is still further desired to provide a device as described above that is relatively light weight and easily transportable.

It is yet further desired to provide a device as described above that is easy to use and economic to fabricate and purchase.

SUMMARY OF THE INVENTION

These and other objects are achieved in one advantageous embodiment by the provision of a hat wearable by a user and having a pedestal with a cup mounted on the crown or top of the hat. A ball is positioned in the cup such that upon movement of the body off of the swing axis, the ball with fall out of the cup thereby alerting the user of an improper swing.

Advantageously, the cup is locate along the swing axis of the user sitting squarely on crown or top of the individual's head such that upon rotation about the user's swing axis, the ball is retained in the cup.

In one advantageous embodiment the pedestal is attached to the hat by a slide mount that allows for adjustability of the pedestal from front to back relative to the individual's head. This is desirable because it allows adjustability of the same device such that it may be worn and used by multiple users. It also allows greater flexibility and adjustability to the swing axis of the particular user who may utilize a particular stance when hitting the ball such that his swing axis changes from stance to stance.

The hat may comprise any suitable hat that will maintain the cup on the crown of the head such as for instance, a baseball hat that can further advantageously provide shading for the eyes. In addition, the pedestal may advantageously be made of a plastic or rigid polymer that is strong yet relatively light weight so as not to influence the individual's gold swing. In one advantageous embodiment the ball is attached to the device by means of a string. In another advantageous embodiment the ball comprises rubber.

Accordingly, in one advantageous embodiment a golf swing assisting device is provided comprising a hat to be worn on a user's head, and a cup attached to the top of the hat and substantially in line with a swing axis of the user, the cup adapted to receive a ball therein. The golf swing assisting device is provided such that the ball will fall out of the cup when the cup is tilted thereby providing the user with an indication.

In another advantageous embodiment a golf swing assisting device is provided comprising a hat to be worn on an individual's head, and a holder attached to the top of the hat and substantially in line with a swing axis of the individual, the holder adapted to receive a ball therein. The golf swing assisting device is further provided where the holder is adjustable relative to the hat such that the holder may be substantially aligned with a the swing axis of the user such that when the user performs a golf swing the ball will fall out of the holder if the holder is tilted.

In still another advantageous embodiment a method of assisting a user in performing a golf swing is provided comprising the steps of locating a holder on the top of an individual's head essentially in line with a swing axis of the individual, and positioning a ball in the holder. The method further comprises the steps of displacing the ball out of the holder by means of gravity when the individual performs the golf swing that tilts the holder off of the swing axis to thereby provide the individual with an indication.

In yet another advantageous embodiment a golf swing assisting device is provided comprising a hat to be worn on an individual's head, and a holder attached to the crown of the hat, the holder adapted to receive a ball therein. The golf swing assisting device is further provided such that the ball will fall out of the holder when the holder is tilted thereby providing the individual with an indication.

Other objects of the invention and its particular features and advantages will become more apparent from consideration of the following drawings and accompanying detailed description.

DETAILED DESCRIPTION OF THE DRAWINGS

Figure 1:
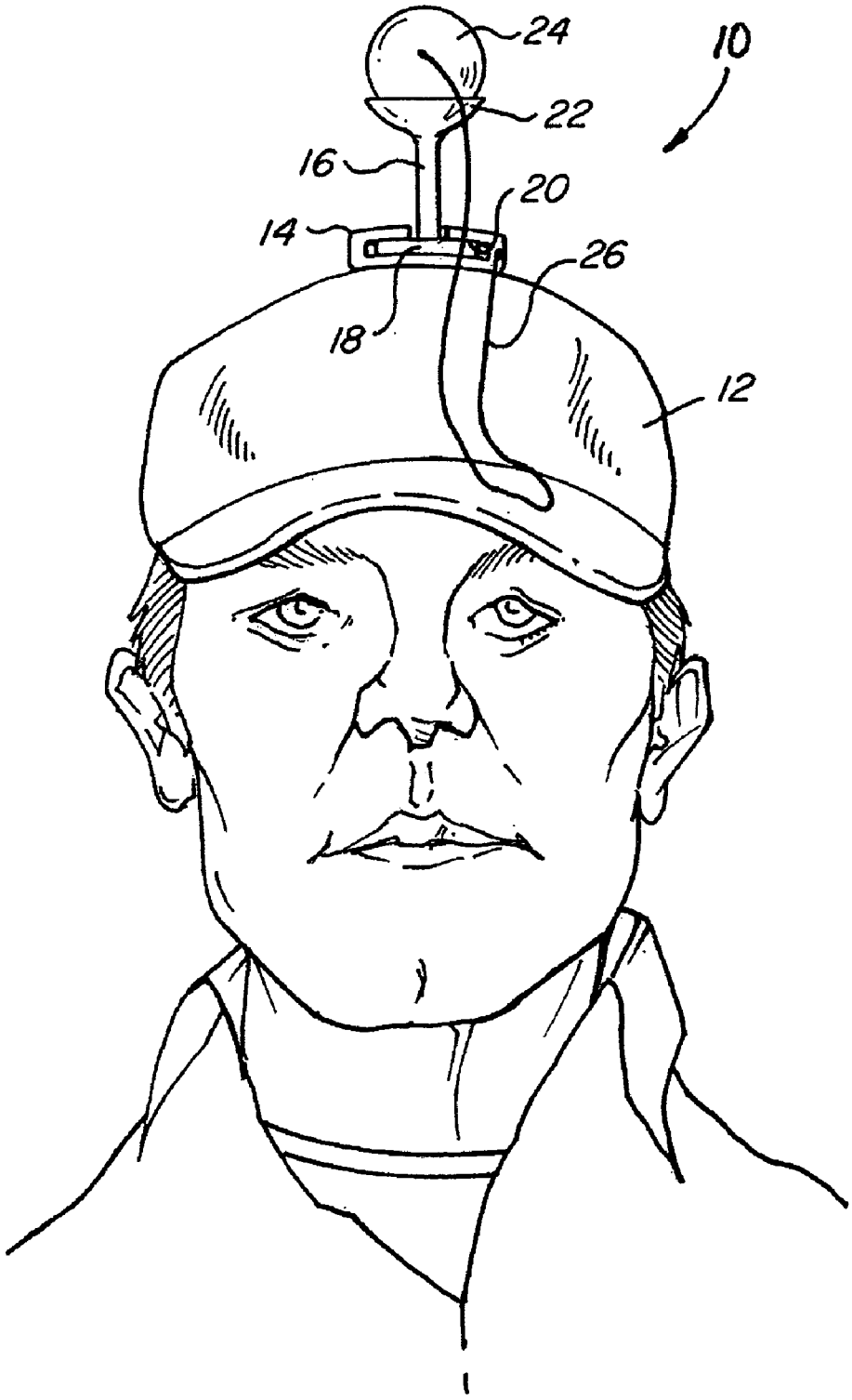
FIG. 1 is a front perspective view of one advantageous embodiment of the present invention.

Referring now to the drawings, wherein like reference numerals designate corresponding structure throughout the views.

FIG. 1 is a front view of golf swing assisting device 10 being worn by an individual. In this advantageous embodiment golf swing assisting device 10 comprises a hat 12 to be worn on the individual's head, a mounting device 14, a pedestal 16, a holder 22, a ball 24 and a string 26.

Hat 12 is illustrated as a baseball style hat but it is contemplated that virtually any style hat may effectively be used in connection with the invention. Mounting device 14 is attached to hat 12 and may be provided as a slide mount. Advantageously the slide mount allows adjustability of golf swing assisting device 10 such that it may be substantially aligned with a swing axis of the individual. Alternatively mounting device 14 may be detachably removable from hat 12 such that hat 12 may be worn before and/or after golfing.

Figure 3:
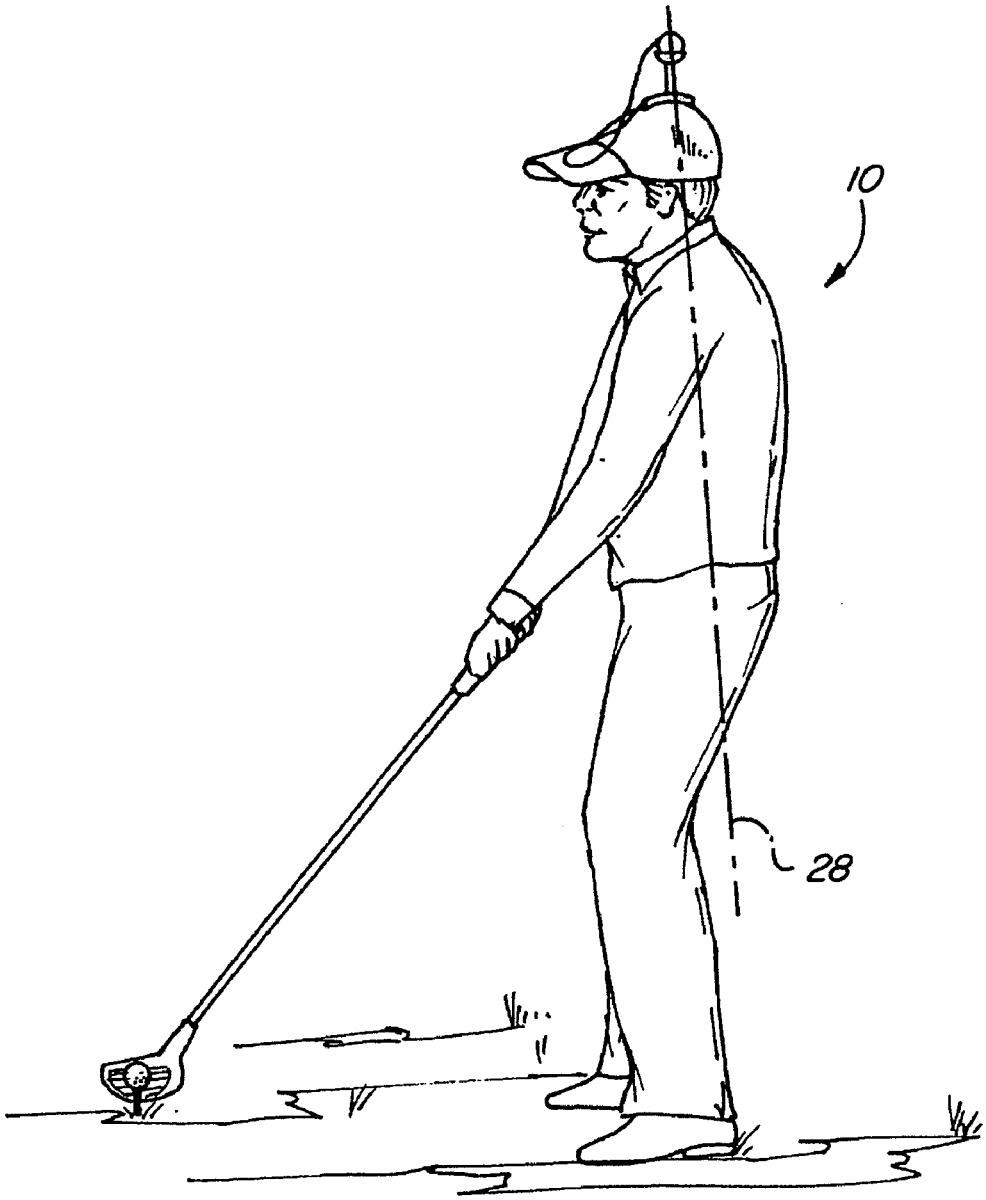
FIG. 3 is a side perspective view of an individual addressing the ball and using the device of FIG. 1 to assist in maintaining his center line during a golf swing.
Figure 4:
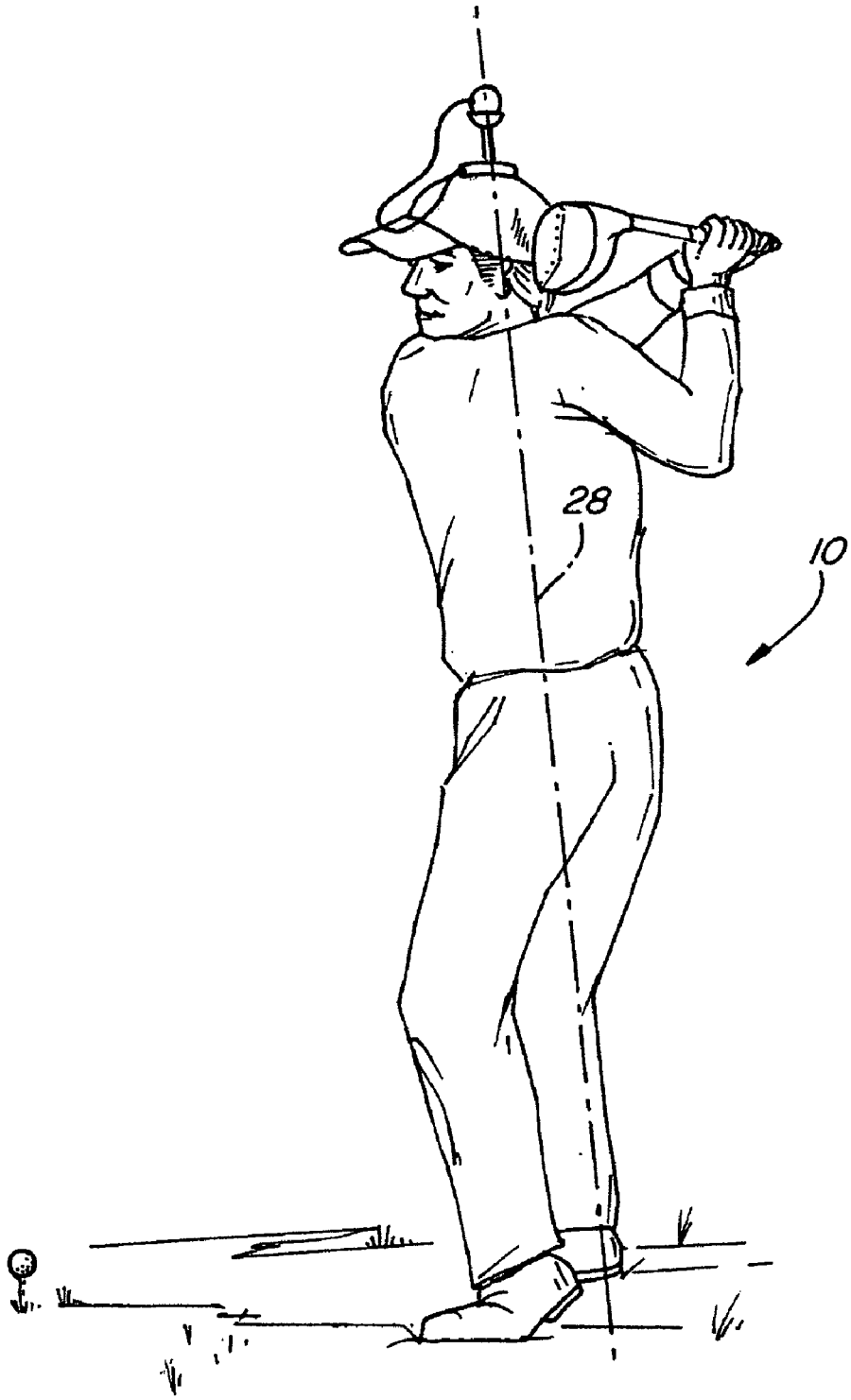
FIG. 4 is a side perspective view according to FIG. 3 of the back swing during the golf swing.
Figure 5:
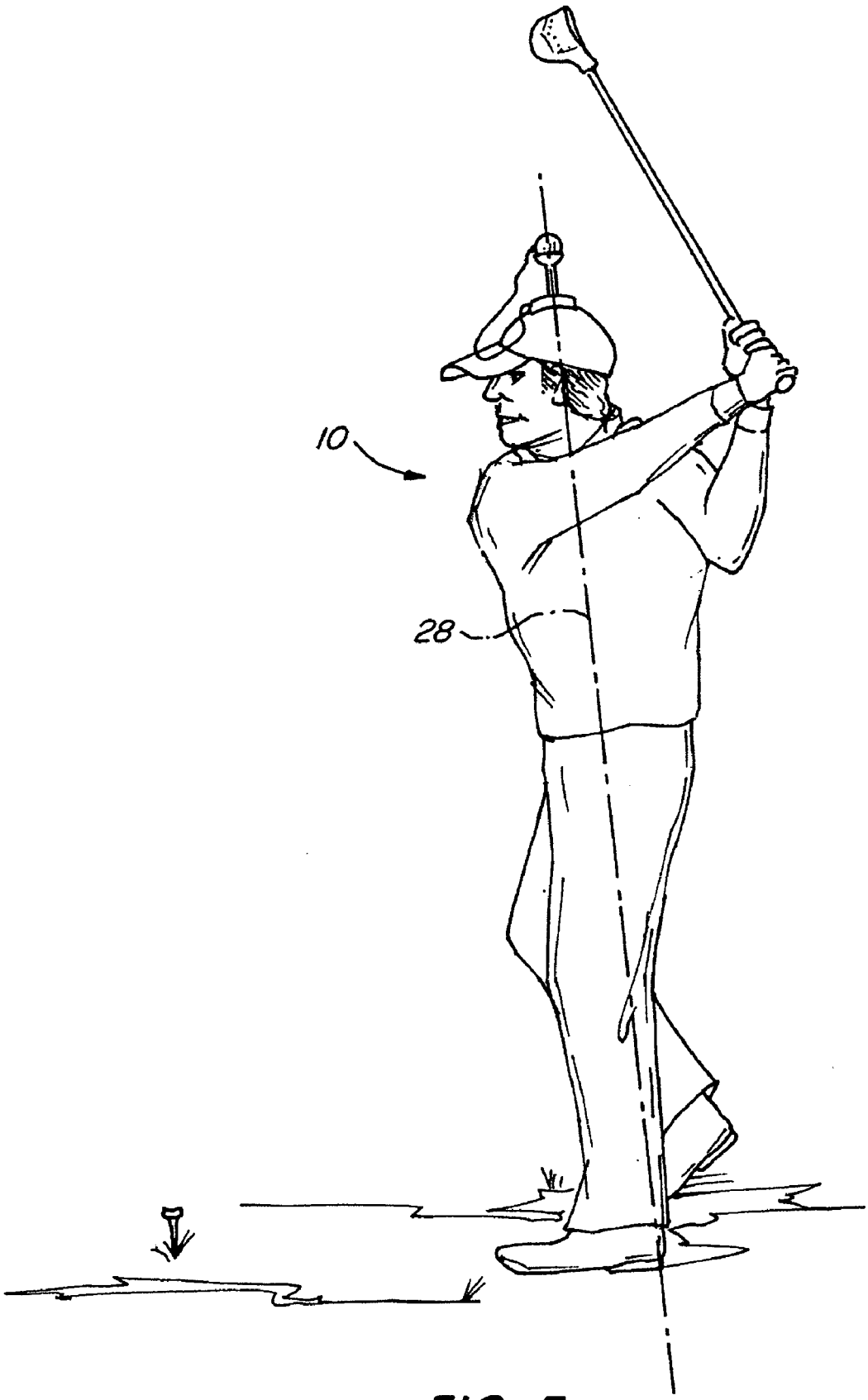
FIG. 5 is a side perspective view according to FIG. 3 of the follow through during the golf swing.

The swing axis 28 of the individual is an imaginary line extending from the top or crown of the individual's head, extending downward through the individual's neck, into the individuals torso and extending through the individual's hips and anus, which may more easily be seen in connection with FIG. 3. It should be noted that while swing axis 28 is illustrated in FIGS. 3–5 as essentially vertical, many differing stances may be utilized such that swing axis 28 may be vertical or off vertical. The important concept is that during the individual's golf swing that he rotate around swing axis 28 such that the individual's head, neck and torso remain aligned with each other about swing axis 28.

Figure 2:
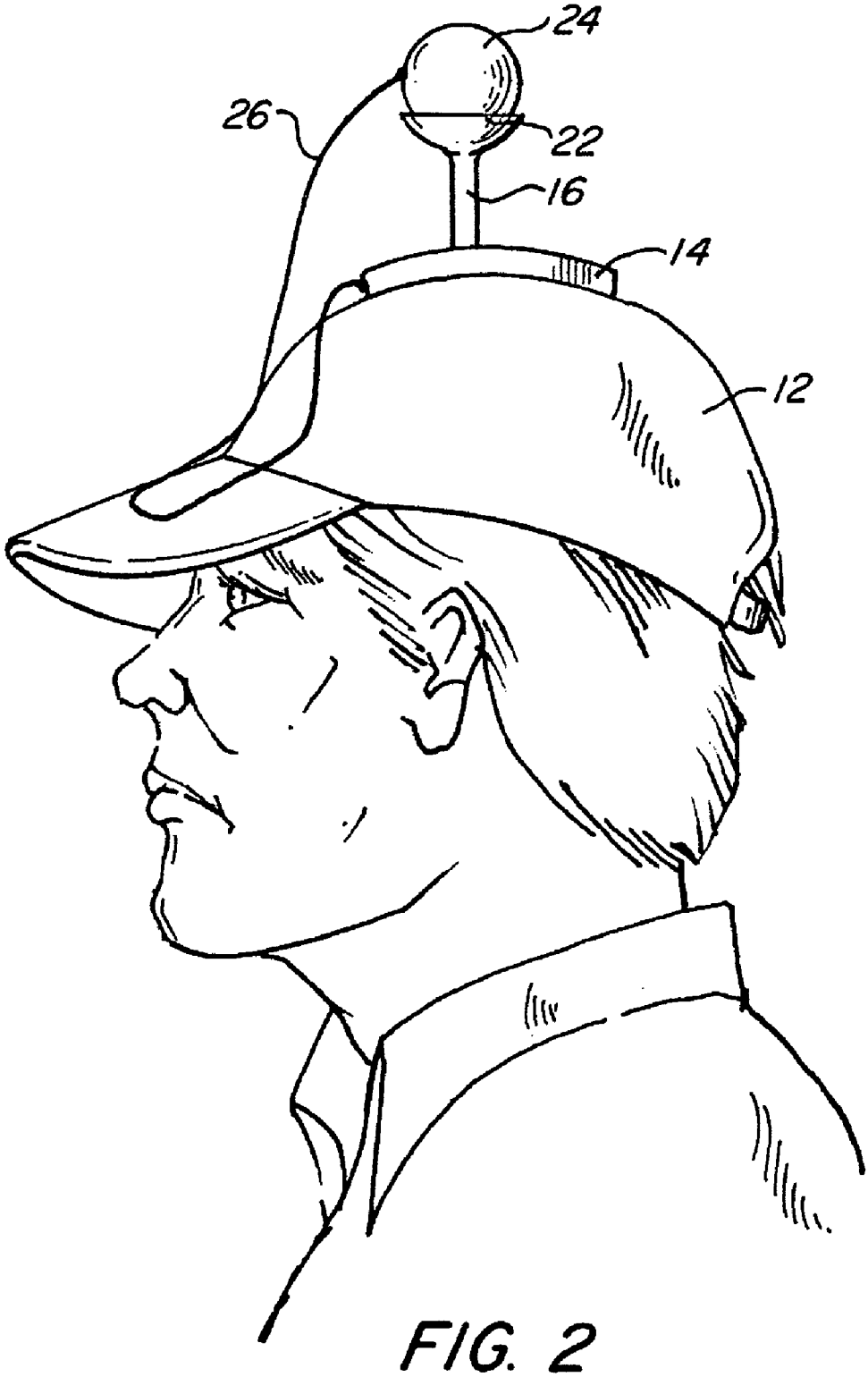
FIG. 2 is a side perspective view of the embodiment according to FIG. 1.

As illustrated in FIGS. 1 and 2, mounting device 14 is attached to the top of or the crown of hat 12. This is a significant difference over the devices previously taught to improve one's golf swing because the prior art fails to disclose a device that addresses one's swing axis 28 because the prior art does not located the device substantially at swing axis 28.

In one advantageous embodiment, mounting device 14 is elongated from front to back (as shown in FIG. 2) such that pedestal 16 may be adjusted forward or backward to substantially any location along a length of mounting device 14. In this manner, pedestal 16 may be adjusted to substantially align with swing axis 28 of the individual. As stated earlier, swing axis 28 may vary from person to person, or an individual may advantageously change his stance, as such pedestal 16 may correspondingly be adjusted. Virtually any common locking mechanism may be utilized in connection with the pedestal 16 to securely hold pedestal 16 in the desired location. Still further it is contemplated that pedestal 16 may be detachably removable from mounting device 14.

Pedestal 16 is provided with a base 18 that engages with a slot 20 located in mounting device 14 such that pedestal 16 is securely affixed to mounting device 14.

Holder 22, which may comprise for instance, a cup, is located at the upper end of pedestal 16 and is designed to hold ball 24. Holder 22 is provided such that ball 24 will not fall out of holder 24 when slightly tilted for instance, forward. In one advantageous embodiment, holder 22 is provided with a raised wall toward the front. But when holder 22 is tilted backward, sideways or too far forward, ball 24 will fall out of holder 22. In addition, a sudden or jerking motion may also dislodge ball 24 from holder 22 providing the individual with an indication that his golf swing was not proper or accurate.

Mounting device 14, pedestal 16 and holder 22 may comprise a rigid plastic or polymer that will provide structural strength but still be relatively light weight so as not to interfere with the individual's golf swing.

Ball 24 is held in holder 22 and in one advantageous embodiment may comprise rubber. Ball 24 is further connected to one end of string 26, which is further connected to base 14. In this manner, if ball 24 becomes dislodged from holder 22, ball 24 will not fall away from the individual. Alternatively, string 26 may be attached to pedestal 16 or holder 22. In any event, it is only important that ball 26 be retained by string 26 such that it does not fall away from the individual.

FIGS. 3–5 illustrate the use of golf swing assisting device 10. In FIG. 3 an individual is illustrated addressing the ball, keeping his head, neck and torso essentially in line with swing axis 28.

FIG. 4 illustrates the individual at the end of his back stroke where the individual's torso and hips have rotated about swing axis 28. It should be noted however, that the individual's head, neck and torso are still essentially in line with swing axis 28 indicating a proper and accurate golf swing.

FIG. 5 illustrates the individual toward the end of his follow through swing. Again, the individual's torso and hips have rotated about swing axis 28, which will result in an accurate golf swing. It should be noted that while the individual's head and neck have not yet rotated, typically the momentum of the swing on the follow through will cause the head and neck to rotate about swing axis 28. If however the individual is not holding his head along swing axis 28, rotation thereof will probably cause ball 24 to be dislodged from holder 22 indicating to the individual that he has incorrectly rotated about swing axis 28.

As stated previously, while swing axis 28 is illustrated in FIGS. 3–5 as a generally vertical line, in practice swing axis 28 may vary from individual to individual. Typically an individual may lean forward slightly over the ball thereby causing swing axis 28 to tilt off of vertical. This however is acceptable as long as when performing a golf swing, the individual rotates correctly about swing axis 28 keeping his head, neck and torso aligned with each other and swing axis 28.

Although the invention has been described with reference to particular ingredients and formulations and the like, these are not intended to exhaust all possible arrangements or features, and indeed many other modifications and variations will be ascertainable to those of skill in the art.

What is claimed is:

1. A golf swing assisting device comprising:

a hat to be worn on a user's head;

a ball;

a cup attached to the top of said hat and substantially in line with a swing axis of the user, said cup adapted to receive said ball therein;

a string connecting said ball to said hat, said string having first and second ends, the first end attached to the ball and the second end attached to an attachment point;

wherein said ball will fall out of said cup when said cup is tilted thereby providing the user with an indication; and the attachment point is located outside of the cup.

2. The golf swing assisting device according to claim 1 wherein said cup is attached to said hat by a pedestal.

3. The golf swing assisting device according to claim 1 wherein the swing axis of the user extends from the top of the head and down through the user's neck and torso.

4. The golf swing assisting device according to claim 1 further comprising an adjustable mount connecting said cup to said hat such that a location of said cup may be adjusted relative to said hat to align said cup with the swing axis of the user.

5. The golf swing assisting device according to claim 4 wherein said adjustable mount is slideable.

6. The golf swing assisting device according to claim 1 further comprising a string attached at one end to the ball and at a second end to said cup.

7. The golf swing assisting device according to claim 1 wherein said cup comprises a plastic or polymer.

8. The golf swing assisting device according to claim 1 wherein said ball comprises rubber.

9. The golf swing assisting device according to claim 1 wherein said ball substantially fills said cup.

10. The golf swing assisting device according to claim 1 wherein said hat comprises a baseball style hat.

11. The golf swing assisting device according to claim 1 wherein the attachment point is located on the surface of said hat.

12. The golf swing assisting device according to claim 1 wherein the attachment point is located on the exterior of said cup.

13. A golf swing assisting device comprising:

a hat to be worn on an individual's head;

a ball;

a holder having a stem that is attached to the top of said hat and substantially in line with a swing axis of the individual, said holder adapted to receive said ball therein;

a string connecting said ball to said hat, said string having first and second ends, the first end attached to the ball and the second end attached to an attachment point that is located on the stem of said holder; and said holder being adjustable relative to said hat such that said holder may be substantially aligned with a the swing axis of the individual such that when the individual performs a golf swing the ball will fall out of said holder if said holder is tilted.

14. The golf swing assisting device according to claim 13 wherein said holder is attached to said hat by a pedestal.

15. The golf swing assisting device according to claim 13 wherein further comprising a slideable mount connecting said holder to said hat.

16. A golf swing assisting device comprising:

a hat to be worn on an individual's head; and a holder attached to the crown of said hat, said holder receiving a ball therein;

a string connecting the ball to the hat, said string connected to said hat at an attachment point that is located outside of said holder; and wherein said ball will fall out of said holder when said holder is tilted thereby providing the individual with an indication.

17. The golf swing assisting device according to claim 16 wherein the attachment point is located on the surface of said hat.

18. The golf swing assisting device according to claim 16 wherein the attachment point is located on the exterior of said holder.

* * * * *